US006857209B2

(12) United States Patent
Wehrwein et al.

(10) Patent No.: US 6,857,209 B2
(45) Date of Patent: Feb. 22, 2005

(54) CORDLESS IRON WITH PIEZOELECTRIC WATER SPRAYER

(75) Inventors: Axel Wehrwein, Rossdorf (DE); Dieter Höhn, Riedstadt (DE); Marcus-Christian Wiedemann, Erbach (DE); Karsten Antonius, Rödermark (DE)

(73) Assignee: Rowenta Werke GmbH, Offenbach (DE)

( * ) Notice: Subject to any disclaimer, the term of this patent is extended or adjusted under 35 U.S.C. 154(b) by 0 days.

(21) Appl. No.: 10/432,255

(22) PCT Filed: Nov. 15, 2001

(86) PCT No.: PCT/IB01/02146

§ 371 (c)(1),
(2), (4) Date: May 22, 2003

(87) PCT Pub. No.: WO02/42545

PCT Pub. Date: May 30, 2002

(65) Prior Publication Data

US 2004/0026398 A1 Feb. 12, 2004

(30) Foreign Application Priority Data

Nov. 22, 2000 (FR) ..... 00 15082

(51) Int. Cl.[7] ..... D06F 75/22
(52) U.S. Cl. ..... 38/77.1
(58) Field of Search ..... 38/74, 77.1, 77.5, 38/77.7, 77.83, 93; 219/245, 250, 258; 251/129.01; 310/311

(56) References Cited

U.S. PATENT DOCUMENTS

| | | | | | |
|---|---|---|---|---|---|
| 2,817,169 | A | * | 12/1957 | Schott | 38/77.1 |
| 4,545,561 | A | * | 10/1985 | Brown | 251/129.08 |
| 4,827,104 | A | * | 5/1989 | Foster, Jr. | 219/251 |
| 5,787,614 | A | * | 8/1998 | Stutzer | 38/77.1 |
| 6,035,563 | A | * | 3/2000 | Hoefer et al. | 38/77.1 |
| 6,382,522 | B2 | * | 5/2002 | Tomkins et al. | 239/102.2 |

FOREIGN PATENT DOCUMENTS

| | | |
|---|---|---|
| DE | 214 404 | 10/1984 |
| DE | 35 38 544 | 5/1987 |
| DE | 197 35 214 | 2/1998 |
| JP | 5 161798 | 6/1993 |
| WO | 88 03579 | 5/1988 |
| WO | 97 21868 | 7/1997 |

OTHER PUBLICATIONS

Patent Abstracts of Japan, Publication No. 08131697, Publication Date, May 28, 1996, "Cordless Steam Iron".
Patent Abstracts of Japan, Publication No. 08215495, Publication Date Aug. 27, 1996, "Spray Iron".
Patent Abstracts of Japan, Publication No. 07289799, Publication Date Nov. 7, 1995, "Steam Iron".

* cited by examiner

*Primary Examiner*—Ismael Izaguirre
(74) *Attorney, Agent, or Firm*—Browdy and Neimark, P.L.L.C.

(57) ABSTRACT

The invention concerns a cordless iron, having a body (1) comprising a handle (11), a soleplate (2), a water storage (3), and comprising an electrically operating water sprayer (4) and an electric power storage cell (7) powering said sprayer (4).

7 Claims, 5 Drawing Sheets

CORDLESS IRON WITH PIEZOELECTRIC WATER SPRAYER

The present invention concerns irons and more particularly irons called "cordless" or "without cord" that permit ironing without the iron being connected by a cord to an outlet or a support during the active ironing phases when the iron is being held by the user.

Such irons have most often an internal electrical heating element. They rest during phases when no ironing is preformed on a support that has a rapid electric current connector, permitting heating of the iron and accumulation in the iron of the energy necessary for the following active ironing phase.

Cordless irons are also known which receive the necessary energy by an electromagnetic inductor or an infrared lamp situated in the support as described in the patent WO 8803579 or by contact of the soleplate with a hot support as described in the patent DE 3538544, or even by a transfer of a liquid mass as in the patent WO 9721866.

The user is thus freed of the annoyance provoked by the cord of conventional electric irons. But to obtain effective ironing, the fabric must often be moistened. The iron having a water reservoir, the user can use the spray or atomizer for abundant local moistening. The iron not being supplied electrically, the spray is generally constituted by a manual pump withdrawing water from a reservoir of the iron and by a jet. But it is difficult with this means to obtain a continuous spray that is fine and well distributed on the surface being ironed.

Also, cordless irons permit in a normal manner the use of steam produced in the iron, which has a water reservoir. This steam, being distributed through orifices of the soleplate is well distributed on the items being ironed. But the accumulated energy is quickly used up, which leads to short active ironing times and to long recovery times in comparison with these active ironing times. For example, a calculation shows that an iron weighing 600 grams producing 20 grams of steam per minute and having an installed power of 2000 Watts can iron during 26 consecutive seconds before becoming too cool. But it then requires at least 20 seconds to return to a good temperature. In effect, steaming of the water is a large consumer of energy and a small percentage of the vapor produced condenses on the fabrics to moisten them, in a manner such that the yield of the operation is low. The wait for reheating the iron between two ironing phases is a limitation of the cordless steam iron.

Moreover, the patent JP 5161798 is known. This patent describes an iron provided with a piezoelectric atomizer, or nebulizer. In one version, the mist produced by the atomizer is projected in front of the iron as would a conventional spray. Therefore, the surface cannot itself be moistened as regularly as would be done by a steam iron whose steam orifices are under the soleplate and a part of the mist is lost into the environment. In another version, the mist arrives on the fabric through a large orifice formed in the soleplate. But this orifice of large dimension is a nuisance to flattening the item and heating it so as to eliminate wrinkles as a result of a corresponding missing part of the soleplate surface. The atomizer requires an electric current and the iron is not cordless.

The patent DE 19735214 describes an iron furnished with a piezoelectric atomizer, permitting moistening of the ironed surface in a regular manner and without producing steam in the iron. The mist produced by the atomizer very close to the soleplate is carefully distributed through several orifices of this soleplate without having to traverse a long path where it would have to be able to be deposited. But the atomizer that produces the mist requires an electric supply to function and the iron is not cordless.

The object of the invention is a cordless iron, comprising a water reservoir, capable of moistening items during ironing, in order to increase its effectiveness, as well as would be done by a steam iron, and having an equal mass, a better ironing self-sufficiency and a better comfort of use than a cordless iron of known type.

The object of the invention is achieved by a cordless iron having a body provided with a handle, a soleplate, a water reservoir, noteworthy in that it comprises a water atomizer functioning electrically and an electric energy accumulator supplying said atomizer.

Atomized water is deposited on the items which it effectively moistens, the soleplate simply dries the ironed fabric, while a steam iron evaporates a great amount of water that is condensed in part on the fabric and must then be dried. The economy in energy due to the absence of vaporization permits the soleplate to remain hot for a longer time and the iron thus has a better self-sufficiency.

The electric energy necessary for the atomizer during the time of an active ironing phase is accumulated in the iron. The atomizer consumes much less energy than does vaporization, which renders possible the accumulation of energy in batteries or in capacitors which are housed without difficulty in the body of the iron.

Advantageously, the atomizer is a piezoelectric device.

This type of device permits, with a reduced size, the production of very fine drops of water, comparable to a mist. It is, moreover, easily controllable.

Preferably, the atomized water is distributed through distribution orifices opening under the soleplate of the iron.

The atomized water in the vicinity of the reservoir is thus well guided toward the item where it is deposited while moistening it in an effective and regular manner, without losses into the environment.

Due to this arrangement, moistening requires little water, substantially two times less than with a steam iron having a comparable effectiveness, increasing the water self-sufficiency of the reservoir.

The thermal energy necessary for ironing being much less, an iron thus constructed of the same thermal mass and the same power as a steam iron only requires a soleplate heating time around 40% less, for a same utilization time, with the same effectiveness. This time is fully sufficient for the simultaneous recharging of the electric accumulator. With the same recharging time, there is available more time for an active ironing phase.

Ironing being obtained with water that is necessary and sufficient to obtain the ironing effectiveness, drying of the fabric is without an excess of steam. This water economy is translated by less humidification and less heating of the environment.

The self-sufficiency and the comfort of use of the iron according to the invention are thus substantially better than those of an equivalent cordless steam iron.

Preferably, the atomizer has a flat circular diaphragm having an axis, the diaphragm being disposed in proximity, and parallel, to the soleplate and being moved by a piezoelectric ring having the same axis, holes for nebulizing the water being distributed on the diaphragm at the outside of the ring above distribution orifices.

Atomized water is deposited on the item being ironed without risking condensation on the surrounding walls due to a short path of the itemized water. The disposition of holes in the diaphragm permits a distribution of the nebulized water on a surface of large diameter.

In a preferred version, the iron has a rapid electric connector having its complementary part on a support, and a circuit for charging the electric energy accumulator coupled to the connector.

The iron is recharged with heat when the user puts it down while connecting it on the support. At least one part of the electric current entering the iron supplies the accumulator through a charging circuit of a type known per se.

In another version, the accumulator charging circuit comprises an electromagnetic armature receiving energy from an electromagnetic inductor situated in the support or in the ironing table.

The transmission of energy necessary for atomizing the water, from the support toward the iron, is rendered possible without an electrical connection. This arrangement is particularly advantageous when the soleplate of the iron is heated without its heating requiring a connection. The user then does not have to assure an electric contact when she puts the iron down. The manual movements are simplified and the ironing is made easier.

Preferably, the energy accumulator is a battery of one or several sealed accumulators of lead.

In comparison with their capacity, this type of accumulator supports high charging currents without notably affecting the number of charging/discharging cycles and without any significant usage restrictions in terms of the ratio of charging current to capacity. Thus the charging time of the accumulator is optimized.

The invention will be better understood from the examples hereafter and from the attached drawings.

Figure 1:
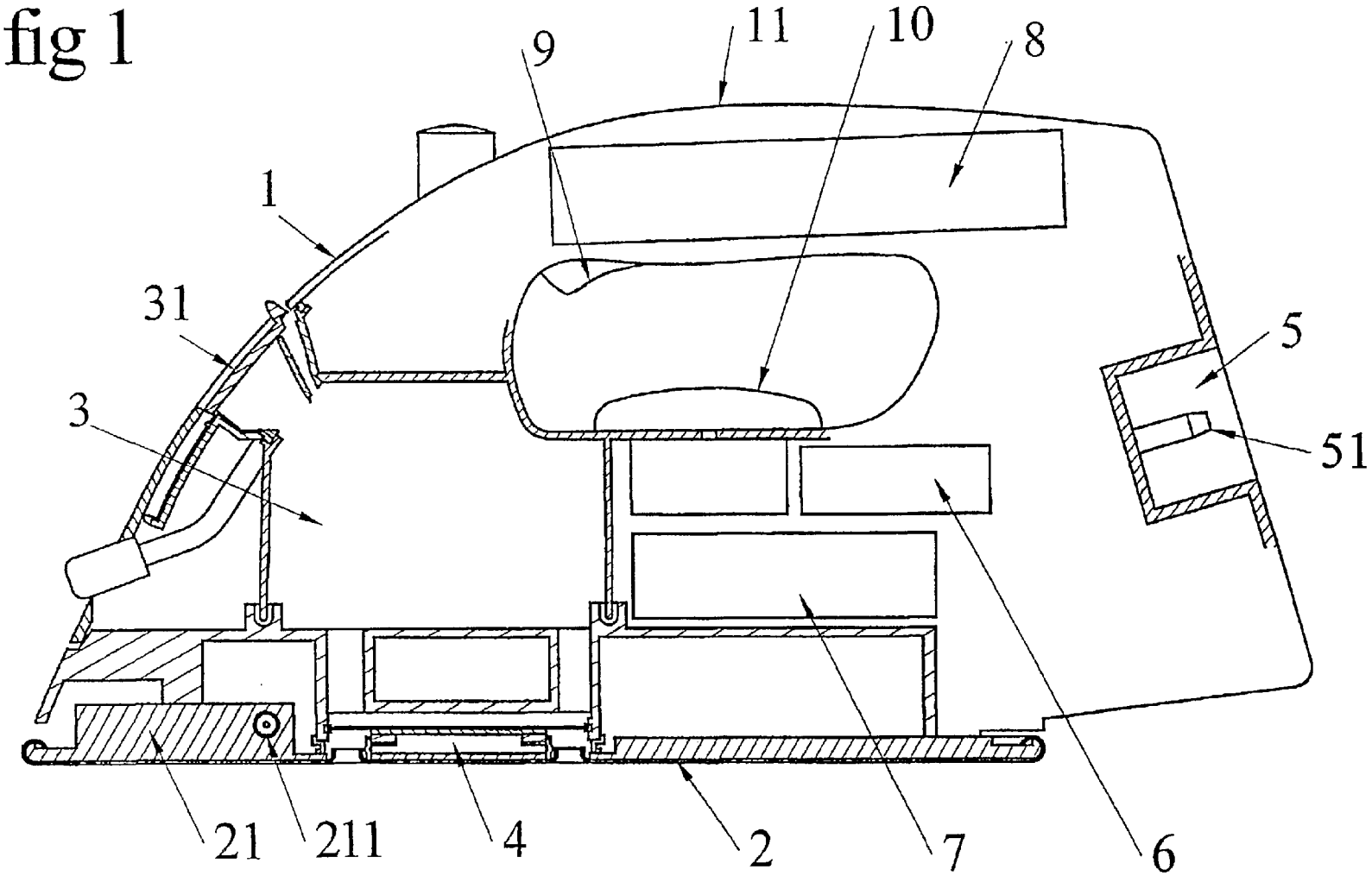
FIG. 1 is a schematic longitudinal cross-section of a cordless iron according to the invention.
Figure 2:
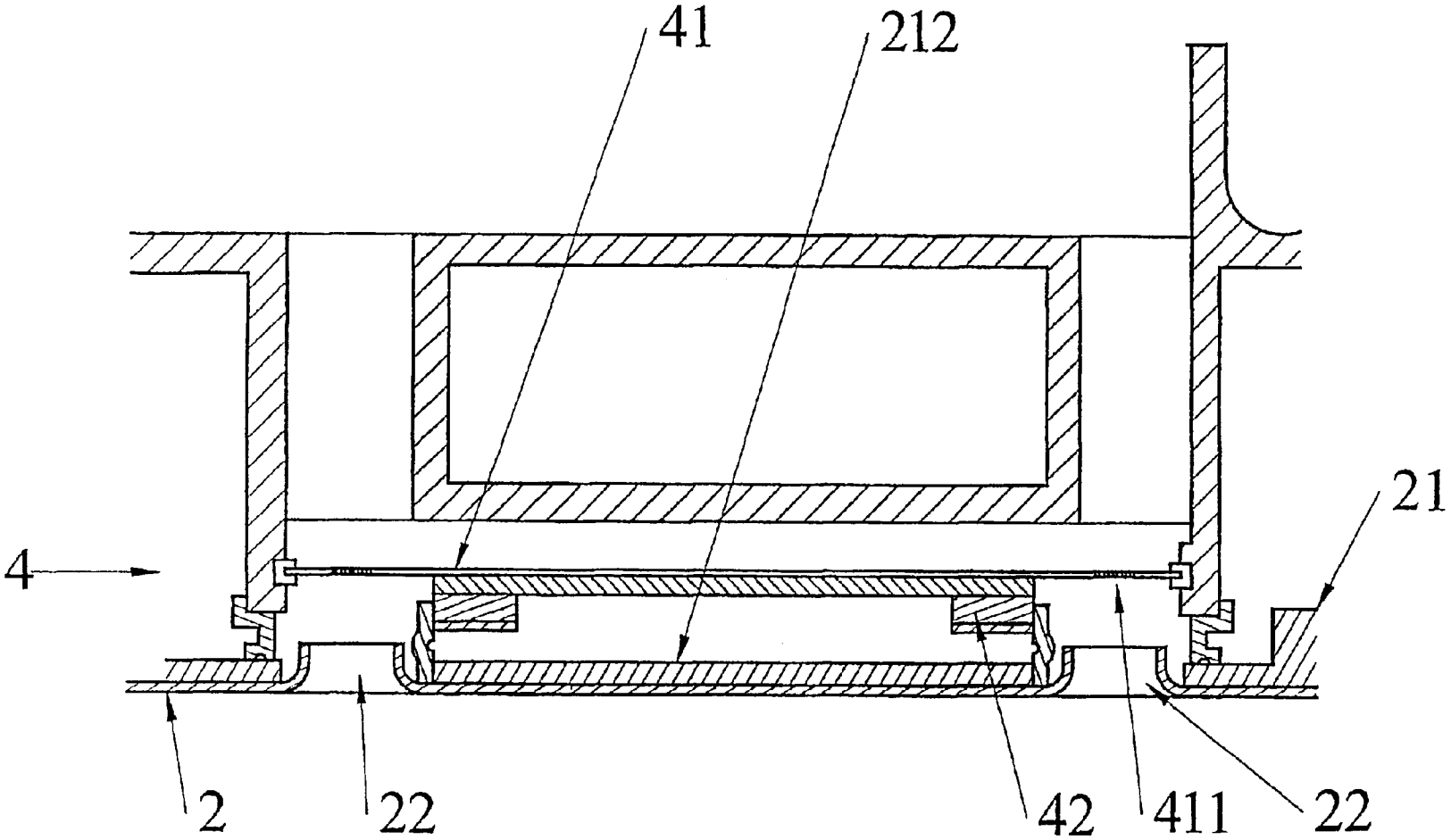
FIG. 2 is a schematic cross-section of the atomizer of the iron.

In a preferential version represented in FIG. 1, the iron has a body 1 with a handle 11, a soleplate 2 fixed to a heating base 21 of a molded aluminum alloy and having a heating element 211, a water reservoir 3 having a refilling orifice 31. Water reservoir 3 is in communication with an atomizer 4 shown more clearly in FIG. 2. Atomizer 4 has a circular diaphragm 41 placed in vibration at an ultrasonic frequency by a piezoelectric ring 42. In a known manner, the diaphragm is pierced with holes 411 sufficiently small to not allow passage of water when the diaphragm is stationary and to atomize it when it vibrates. These holes are preferably disposed at the outside of ring 42 on a zone of large diameter and above outlet openings 22 passing through heating base 21 and soleplate 2. Preferably, openings 22 have the form of a part of a crown having same axis as the ring and their width does not exceed ten millimeters. The openings form a discontinuous circle, which permits part 212 of the heating base located under ring 42 and diaphragm 41 to be an integral part of the rest of base 21, in particular to transmit heat to soleplate 2.

In a preferred version, the iron has an electric connector 5, the male prongs 51 of which are visible in FIG. 1 permitting the iron to receive electric current from the power mains.

This connector is coupled to a charging circuit 6 of a battery of storage cells 7 and, via a thermostatic device adjustable by the button 10, to heating 211. Preferably, battery 7 is composed of two sealed storage cell elements of lead. For example, the battery CPS405 manufactured by Vision, having a capacity of 0.5 ampere hour at a voltage 4 volts is quite suitable, and its volume of less than 30 cc is easily housed in the iron.

Battery 7 assures the supply of electricity to the control and adjustment circuit 8 for atomizer 4. A control 9 in the form of a trigger situated under handle 11 permits the atomizer to be turned on. Preferably, circuit 8 also has the elements of an electronic thermostat.

Figure 3:
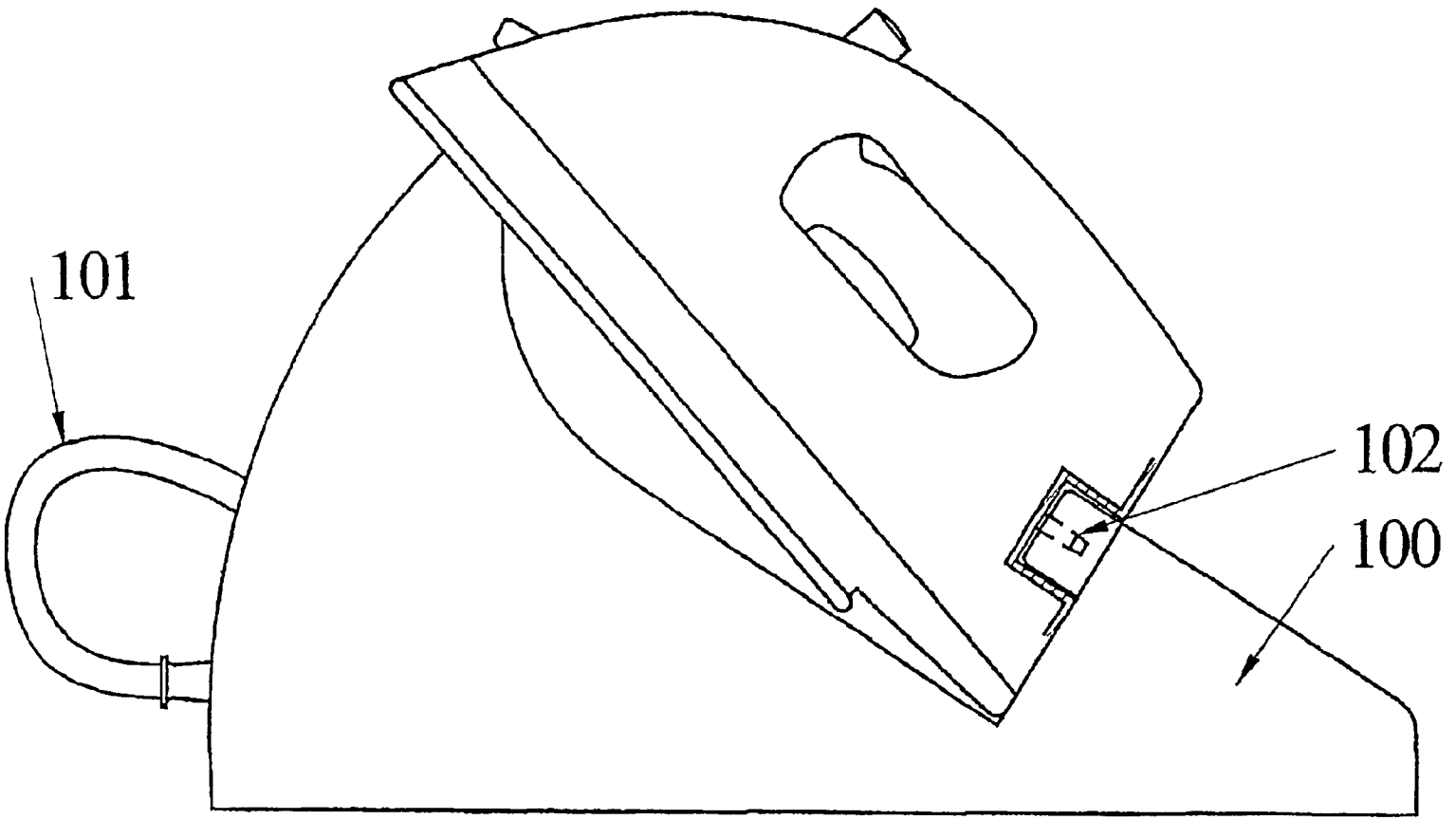
FIG. 3 is a view of the iron placed on a support showing the electric connection of the iron on the support, in partial cross-section.

During ironing times when the iron is inactive, the housemaker places it on a support 100 visible in FIG. 3, connected to the electric power mains by a cord 101. Support 100 has a connector 102 complementary to connector 5 of the iron and receiving electric current from cord 101. The ergonomics of the assembly are provided so that, when the homemaker places the iron on support 100, connector 5 of the iron nests easily on that of the support. The electric connection is thus assured, which permits the iron to be recharged.

When the homemaker wants to iron, she connects the cord of support 100 to an outlet of the electric power mains, fills reservoir 3, adjusts the desired temperature of the iron by button 10 and places the iron on the support. The electrical connection between connector 5 of the iron and connector 102 of the base is established and the iron is heated to the desired temperature. Simultaneously, circuit 6 recharges the storages cell battery 7.

When the iron is hot, the homemaker can take hold of it to effectuate an ironing which hardly consumes more energy than dry ironing of a moist item, even when, in acting on trigger 9 she turns on atomizer 4. The thermal energy stored in the soleplate is suitable for a continuous pressing time much longer than if the iron had produced steam. Atomizer 4 consumes with circuit 8 very little energy beyond the thermal energy of the soleplate, with a power of less then ten watts, in the example described three watts, easily furnished by previously charged battery 7. This power is to be compared to some 900 thermal watts which would be consumed to vaporize the quantity of water necessary for a comparable ironing effectiveness. One then understands that the iron described greatly economizes energy which permits a better self-sufficiency in comparison with known cordless irons.

In addition, the manner of moistening the fabric economizes water. There is needed for a comparable ironing effectiveness, two times less water than required for moistening with steam. The self-sufficiency in water of the iron is substantially increased.

During the following pause, the homemaker again places the iron on support 100 where the soleplate is reheated in a known manner and the battery is recharged. The charging current of lead battery 7 can be increased without compromising its capacity, and the charging time of the battery does not provoke an increase in the pause time. A new phase of use can then be taken.

Figure 4:
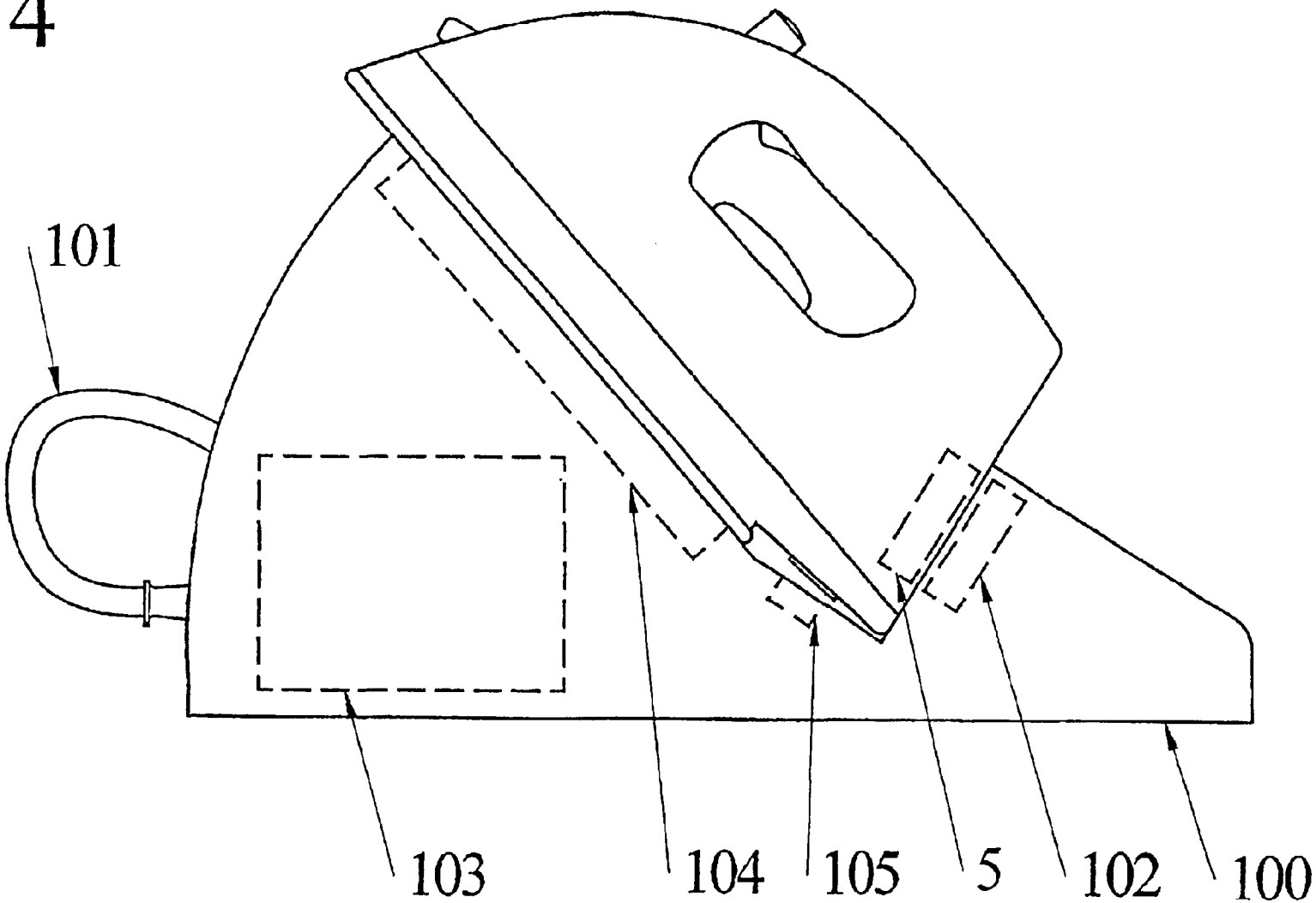
FIG. 4 is a second version of an iron according to the invention placed on a support.

In a second version visible in FIG. 4 and derived from the proceeding, support 100 has a control circuit 103 that controls a first high frequency inductor 104 and a second inductor 102. Inductor 104 is found in proximity to the soleplate of the iron placed on the support and heats it by induction. Second inductor 102 is found in proximity to the heel of the iron placed on the support. The heel of the iron does not have a connector but an armature 5 receiving flux from inductor 102. The charging circuit of the iron is connected to armature 5 and it rectifies the current therefrom to charge the battery. Support 100 also has a set of sensors

105 permitting detection of the presences of the iron and the reading of information concerning the temperature of the soleplate. Presence detection can preferably be optical due to a reflecting plate provided under the heel of the iron, or magnetic. Information on the temperature of the soleplate can be read directly by an appropriate sensor, or transmitted from the iron to the base by a signal emitted by the regulation circuit of the iron.

The function of the iron is identical to that of the proceeding iron, but does not necessitate any physical connection between the iron and its support, which causes the ironing to be even easier.

Figure 5:
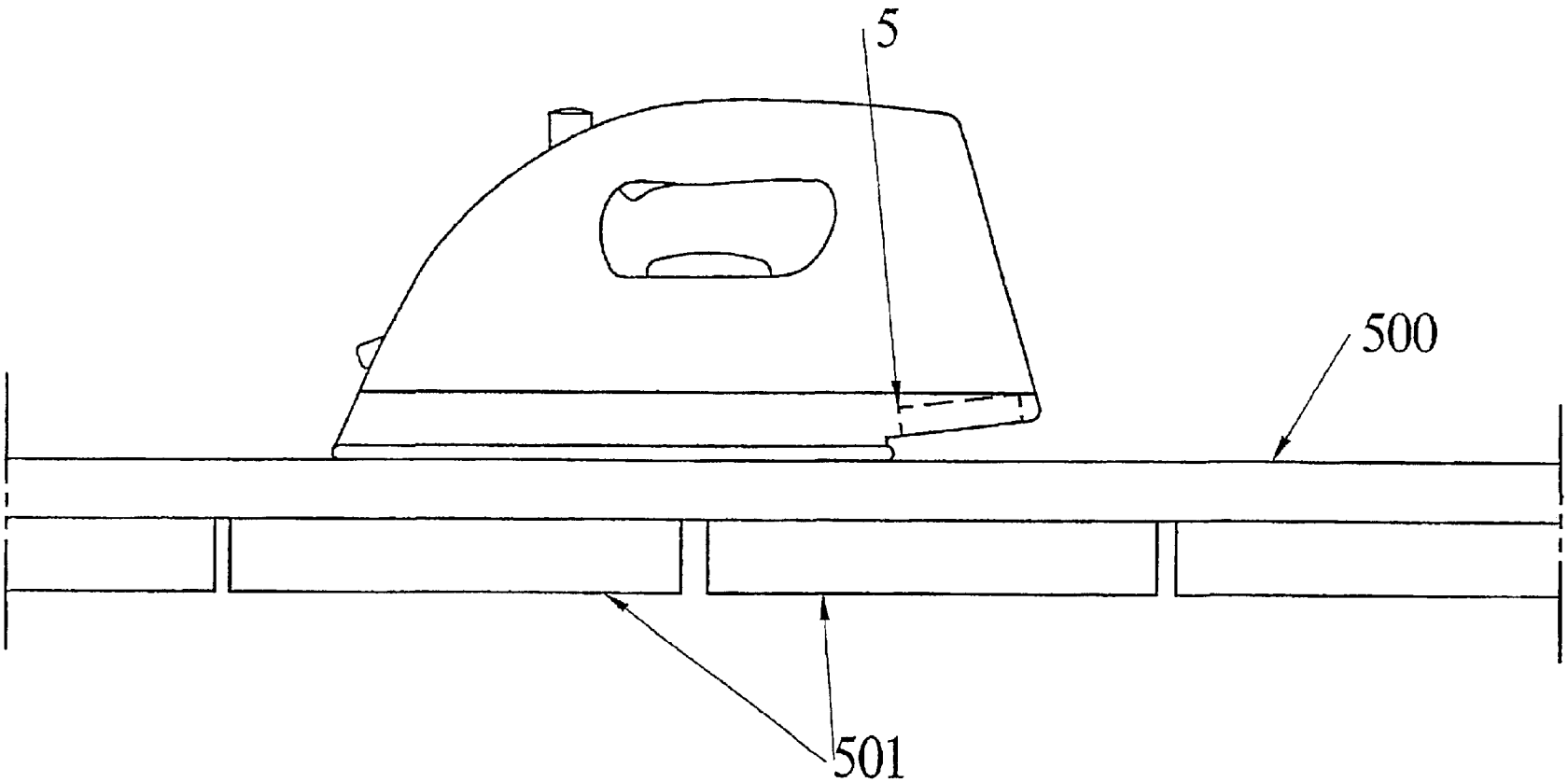
FIG. 5 is a third version of an iron according to the invention placed on an induction ironing table.

In a third version derived from the proceeding and visible in FIG. 5, armature 5 of the iron is disposed in a manner substantially parallel to the soleplate, for example in the substantially horizontal part of the heel. The iron is used with an induction ironing table 500 provided with inductors 501 whose function is known. One part of the flux from inductors 501 arrives at armature 5, which permits recharging of the battery, even during active ironing phases, which are then not limited in duration. The iron benefits to a maximum from the increase in the self sufficiency of the water of the reservoir, due to the use of an atomizer and of the arrangement described.

What is claimed is:

1. Cordless iron, having a body (1) provided with a handle (11), a soleplate (2), a water reservoir (3), characterized in that it comprises a water atomizer (4) functioning electrically and an electric energy accumulator (7) supplying said atomizer (4).

2. Cordless iron according to claim 1 characterized in that the atomizer (4) is a piezoelectric device.

3. Cordless iron according to claim 2 characterized in that the atomized water is distributed through distribution orifices (22) opening under the soleplate (2) of the iron.

4. Cordless iron according to claim 3 characterized in that the atomizer (4) has a flat circular diaphragm (41) having an axis, the diaphragm being disposed in proximity, and parallel, to the soleplate (2) and being moved by a piezoelectric ring (42) having the same axis, holes (411) for nebulizing the water being distributed on the diaphragm (41) at the outside of the ring (42) above distribution orifices (22).

5. Cordless iron according to claim 4 characterized in that the iron has a rapid electric connector (5) having its complementary part (102) on a support (100), and a circuit (6) for charging the electric energy accumulator (7) coupled to the connector (5).

6. Cordless iron according to claim 4 characterized in that the accumulator charging circuit comprises an electromagnetic armature (5) receiving energy from an electromagnetic inductor (102) situated in the support (100) or in the ironing table (500).

7. Cordless iron according to claim 4 characterized in that the energy accumulator (7) is a battery of sealed accumulators of lead.

* * * * *